US005638651A

United States Patent [19]

Ford

[11] Patent Number: 5,638,651

[45] Date of Patent: Jun. 17, 1997

[54] INTERLOCKING PANEL BUILDING SYSTEM

[76] Inventor: Vern M. Ford, 6287 N. 25 E., Idaho Falls, Id. 83401

[21] Appl. No.: 668,238

[22] Filed: Jun. 21, 1996

Related U.S. Application Data

[63] Continuation-in-part of Ser. No. 295,598, Aug. 25, 1994, abandoned.

[51] Int. Cl.[6] ..... E04C 2/30; E04C 2/292

[52] U.S. Cl. ..... 52/309.7; 52/90.1; 52/265; 52/269; 52/271; 52/284; 52/293.3; 52/277; 52/309.9; 52/794.1; 52/800.12

[58] Field of Search ..... 52/90.1, 92.1, 52/93.2, 262, 264, 265, 267, 269, 271, 274, 284, 293.3, 309.7, 309.9, 309.11, 309.16, 592.1, 592.3, 656.4, 794.1, 800.1, 800.11, 800.12, 801.1, 802.1, 276, 277, 279

[56] References Cited

U.S. PATENT DOCUMENTS

| | | | |
|---|---|---|---|
| 2,175,579 | 10/1939 | Stratton | 52/592.1 |
| 3,462,897 | 8/1969 | Weinrott | 52/265 X |
| 3,665,662 | 5/1972 | Timbrook et al. | 52/262 |
| 3,719,016 | 3/1973 | Randolph | 52/265 X |
| 3,874,983 | 4/1975 | Hay, II et al. | 52/309.9 X |
| 4,057,948 | 11/1977 | Wise | 52/265 X |
| 4,163,349 | 8/1979 | Smith . | |
| 4,283,898 | 8/1981 | Claver | 52/584.1 |
| 4,628,650 | 12/1986 | Parker | 52/265 |
| 4,633,634 | 1/1987 | Nemmer et al. | 52/474 |
| 4,712,352 | 12/1987 | Low | 52/794.1 |
| 4,720,948 | 1/1988 | Henley et al. . | |
| 5,245,809 | 9/1993 | Harrington | 52/309.11 |
| 5,265,389 | 11/1993 | Mazzone et al. | 52/309.7 |
| 5,269,109 | 12/1993 | Gulur | 52/309.9 |
| 5,373,678 | 12/1994 | Hesser | 52/309.9 X |
| 5,497,589 | 3/1996 | Porter | 52/592.1 X |
| 5,524,400 | 6/1996 | Schmechel | 52/309.7 X |

*Primary Examiner*—Carl D. Friedman
*Assistant Examiner*—Kevin D. Wilkens
*Attorney, Agent, or Firm*—Hopkins Roden Crockett Hansen & Hoopes, PLLC

[57] ABSTRACT

This invention discloses to an interlocking insulated panel building system that has expanded polystyrene panels sandwiched between inner and outer oriented strand board (OSB) skins. Structural strength is enhanced and thermal shorts are reduced by use of channels formed from typically 22 gauge (0.03") galvanized steel. The panels are interfitted by a tongue-and-groove system. The components of the system are wall panels, headers, sills, beams, and roof panels.

15 Claims, 8 Drawing Sheets

18
22
40
14
32
32
42
15
12
20
12
12
15
3B
3B
44
24
24
46
40
10
42

INTERLOCKING PANEL BUILDING SYSTEM

CROSS-REFERENCE TO RELATED APPLICATIONS

This is a continuation-in-part of application Ser. No. 08/295,598, filed Aug. 25, 1994 abandoned.

TECHNICAL FIELD

This invention relates to an interlocking insulated panel building system that has expanded polystyrene panels sandwiched between inner and outer oriented strand board (OSB) skins. Structural strength is enhanced by use of a channel formed from 22 gauge (0.03") galvanized steel. The panels are interfitted by a tongue-and-groove system.

BACKGROUND OF THE INVENTION

Wood home builders have two basic options for forming walls, ceilings, roofs, etc. The first, a long standard method, consists of using 2×4" studs, sills, and plates and 2×6" rafters, insulating between this lumber and between an inner and an outer sheathing. The insulation thickness in this case is 4" or less; and each stud, sill, and plate provides an insulation short from inner wall to outer sheathing.

More recently, prefabricated panel construction has been developed where panels of expanded polystyrene are sandwiched between fiberboard, plywood, oriented strand board, etc.

U.S. Pat. No. 4,720,948 discloses an insulated building panel that has overlapping skins. However, the panels still use 2×4" wood posts that join the panels and also in conduit supports, door headers, and corner posts, reducing the insulation R-values in those areas. The post construction also makes more air paths between panel sections.

U.S. Pat. No. 4,163,349 discloses a second insulated building panel that uses a considerable amount of wood as headers, sills, nailing strips, beams, plates, etc., creating a multitude of thermal "shorts". The method is silent on sealing of air leaks between panels.

Metal parts are not used as structural material in either of the above referenced patents.

It is the purpose of this invention, therefore, to develop a building construction system that: is easy to fabricate; has a high insulating "R" factor, i.e., greater than 25; is strong; uses simple available materials; has fewer parts; and is lighter than other prefabricated building components.

SUMMARY OF THE INVENTION

This building system consists of prefabrication of the following parts: a 4×8 foot wall section, longer (16–28') top and bottom 3½×5" sills, top and bottom headers for windows and doors, wall panels adjacent to the doors and windows, beams and a roof section. An insulating material core of expanded polystyrene is used in all sections. Structural rigidity is enhanced and thermal shorts are reduced by channels formed from 22 gauge (0.03") or thicker galvanized or zinc-alloy-coated steel. The steel channels and cores are sandwiched generally between oriented strand board (OSB), and all mating parts are glued. Nails and/or screws provide additional support. Recessed areas interfit with an extended core-and-channel section to provide a tongue-and-groove type connection between panels, sills, and headers.

After assembling, interfitting, and gluing the parts, nails and/or screws are driven into the overlapping, interfitting parts to provide a very strong and rigid wall.

The modular construction system generally consists of:

- a rectangular wall section having inner and outer wooden wall skins, the wall section further comprising:
  - an expanded polystyrene rectangular wall core sandwiched between and glued to the wall skins, said wall core having an exposed vertical side extending beyond the skins;
  - a pair of metal wall channels attached and glued to opposite exposed sides of the wall core, wherein a first flange of each wall channel is embedded in the wall core and a second flange of each wall channel covers an end of the exposed vertical side, and wherein a second vertical wall core side and top and bottom core portions have a recessed area within the wall skins;
- top plate and bottom plate each comprising:
  - an elongate rectangular expanded polystyrene beam;
  - a pair of metal plate channels attached and glued to two opposing sides of the insulating beam, wherein the top and bottom plates interfit within the top and bottom core portion recessed areas;
- a top header comprising:
  - inner and outer rectangular wooden top header skins;
  - a rectangular expanded polystyrene top header panel sandwiched and glued between a pair of opposing metal header channels and the inner and outer top header skins, and having a recessed area in a top portion of the top header panel;
  - a wood plate adjacent to a bottom portion of the top header panel;
- a bottom header comprising:
  - inner and outer rectangular wooden bottom header skins;
  - a rectangular expanded polystyrene bottom header panel sandwiched and glued between a pair of opposing metal bottom header channels and the inner and outer bottom header skins, and having a recessed area in a bottom portion of the bottom header panel;
  - a wood plate adjacent to a top portion of the bottom header panel;
- a rectangular roof section comprising:
  - upper and lower rectangular wooden roof skins;
  - a rectangular expanded polystyrene roof core sandwiched and glued between the roof skins, said roof core having a first longer exposed side and a second opposite side having a recessed area;
  - a pair of opposing metal roof channels attached and glued to the first exposed side of the roof core wherein a first flange of each roof channel is embedded in the roof core and a second flange of each roof channel covers an end of the first exposed side, thereby permitting interfitting of the exposed side within a recessed area of a second adjacent roof section; and
- a structural beam comprising:
  - inner and outer oriented strand board beam skins
  - a rectangular expanded polystyrene beam core sandwiched and glued between a pair of opposing metal beam channels and the inner and outer beam skins.

Other objects, advantages, and capabilities of the present invention will become more apparent as the description proceeds.

DETAILED DESCRIPTION OF THE INVENTION

Figure 1A:
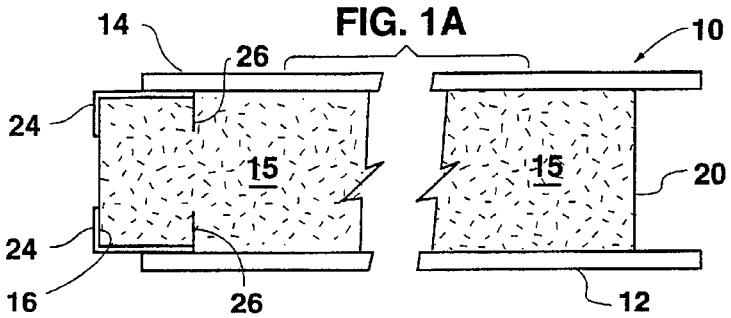
FIG. 1A is a top view of a wall section of the present invention.
Figure 1B:
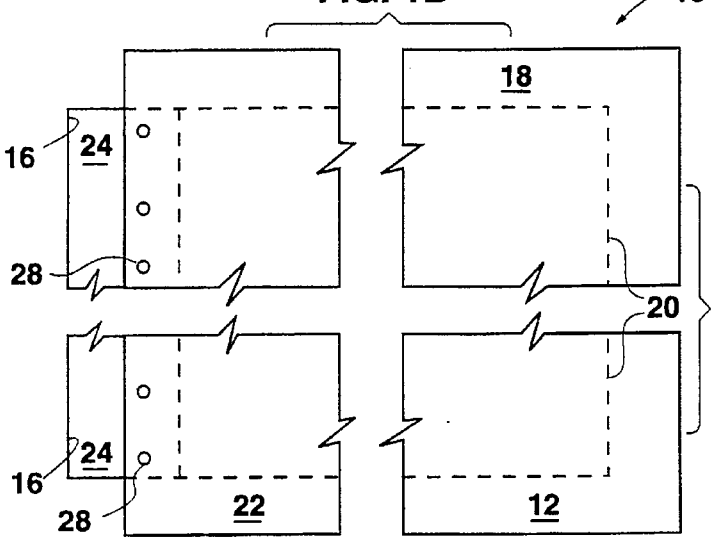
FIG. 1B is a front elevation of the wall section.
Figure 1C:
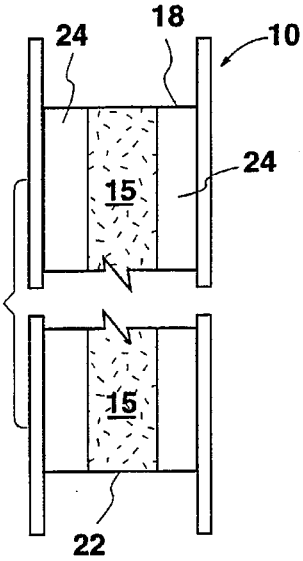
FIG. 1C is a side elevation of the wall section.

Referring to FIGS. 1A, 1B, and 1C, the 4-foot wide by 8-foot tall wall sections 10 are illustrated. The inside skin 12 and outside skin 14 are, typically, oriented strand board (OSB) of about ⅜ to 1" thickness and having the 4×8' dimensions. Sandwiched between the two skins 12 and 14 is 5½" expanded polystyrene (EPS) insulating core 15 having one vertical side extending 1¾" out from the OSB edge as at 16 and having recessed areas at the top 18, wall core edge 20, and bottom 22. The skins 12 and 14 are glued to the core 15 using a high-strength contact cement. Structural integrity is added to this section 10 by forming channels 24 from 22 gauge (0.033") or thicker galvanized or zinc-coated steel and then attaching them to opposite sides of the extended section EPS core. The channels 24 are a 3½" web and have a first 1½" flange covering a portion of the edge 16 of the core 15, and a second 1½" flange inserted vertically into a slot 26 in the core 15 that is made by a hot wire machine. They are also glued using the contact cement. Obviously, the channels 24 are installed in the core 15 prior to gluing the OSB to the core. The structure is further strengthened by nailing and/or screwing the OSB 12 and 14 through the channels 24 as at 28.

Figure 2A:
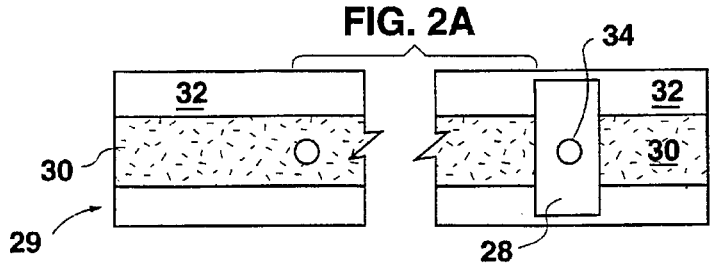
FIG. 2A is a top view of a plate of the present invention.
Figure 2C:
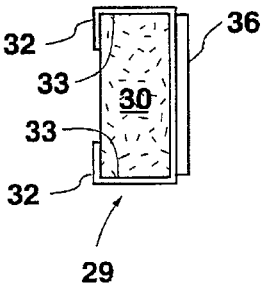
FIG. 2C is a side elevation of the plate.
Figure 2B:
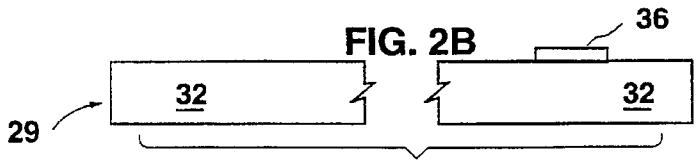
FIG. 2B is a front elevation of the plate.

Referring now to FIGS. 2A, 2B, and 2C, the illustrations show a top (or bottom) plate 29. An elongate EPS beam 30 is sandwiched between two opposing channels 32 each having 1½" flanges facing the opposing edges 33 and a 3½" web. The beam 30 is about 5½×3½" and can be made in lengths up to 28 feet. When used as a bottom plate, the bores 34 are drilled to accept a bolt from below. The bracket 36 is used to act as a washer over the bolt and to span the two channels.

Figures 3A, 3B:
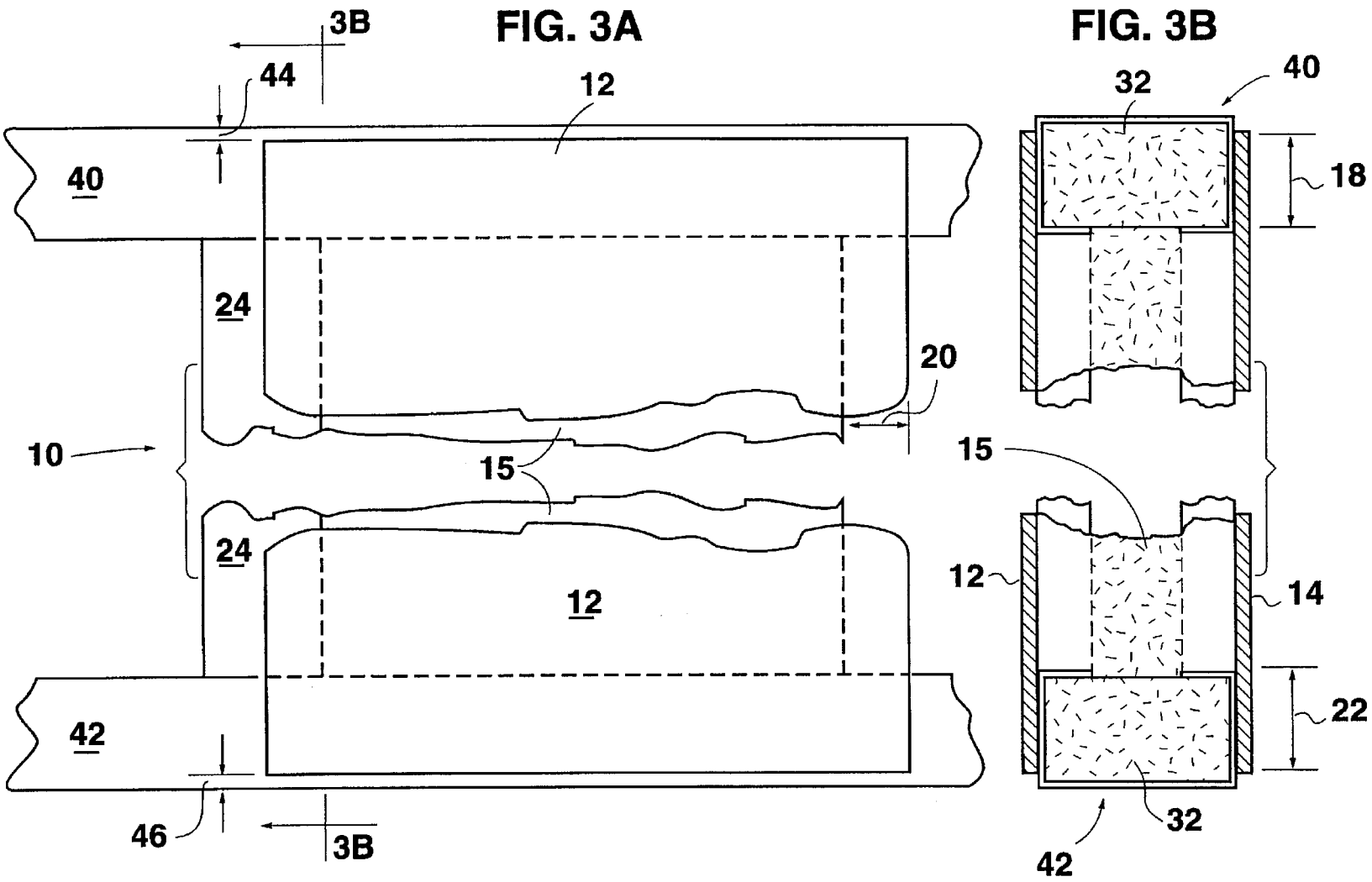
FIG. 3A is a front elevation of the wall section and plate.
FIG. 3B is a side-section view taken along lines 3B—3B of FIG. 3A.
Figure 4B:
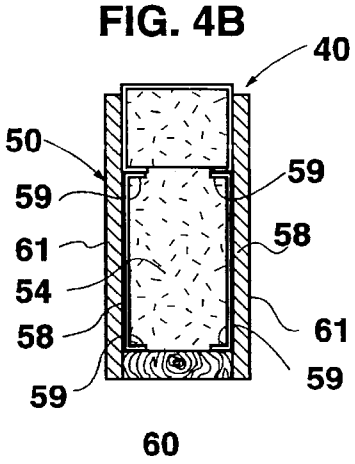
FIG. 4B is a side-section view taken along lines 4B—4B of FIG. 4A.
Figure 4A:
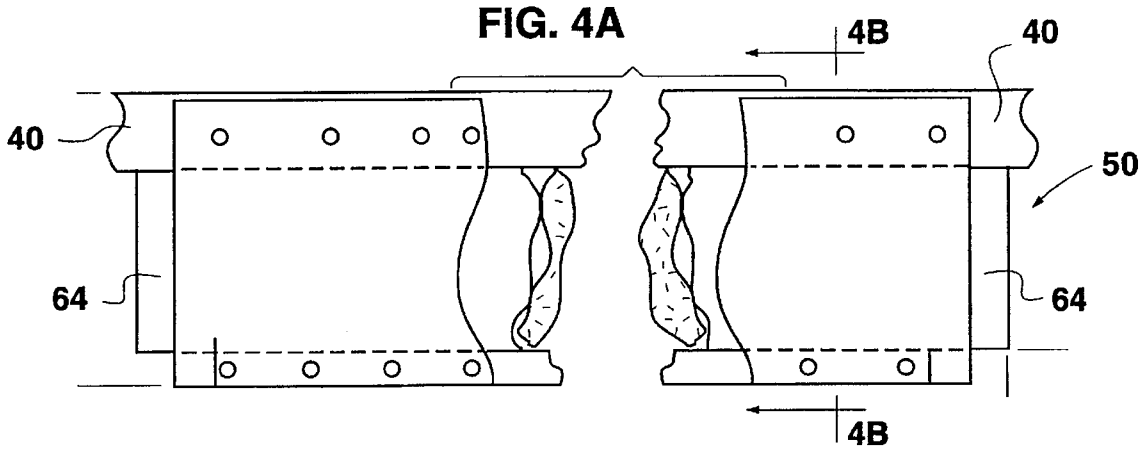
FIG. 4A is a front-cutaway elevation of a top header.
Figure 5B:
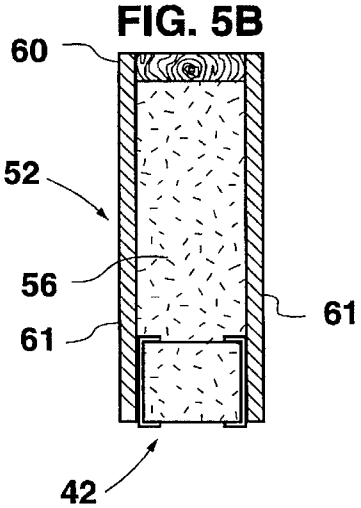
FIG. 5B is a side-section view taken along lines 5B—5B of FIG. 5A.
Figure 5A:
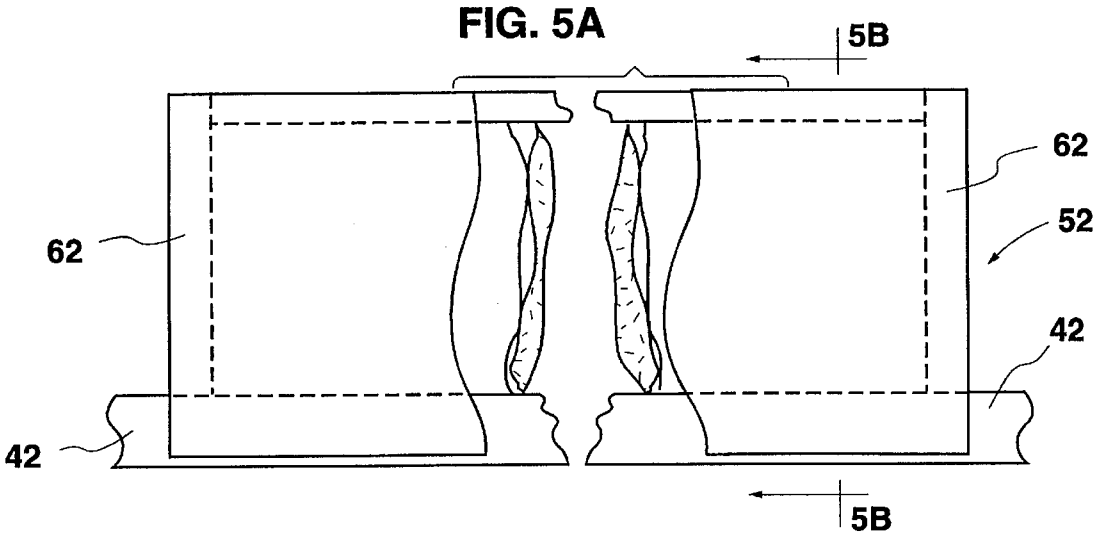
FIG. 5A is a front-cutaway elevation of a bottom header.

The assembly of a wall section 10 and top and bottom plates 40 and 42 can be seen in FIGS. 3A and 3B. The recessed areas 18 and 22, having a depth of about 3", allows ½" of channel 32 to extend above and below the OSB 12 and 14 skins as seen at dimensions 44 and 46. The cutaway also shows recessed area 20 that would interfit with extended section 24 of an adjacent panel.

The ½" bottom clearance 46 under OSB skin 12 allows room for later installed flooring, and the top clearance 44 accommodates roof truss structure (not shown).

FIGS. 4A, 4B, 5A, and 5B illustrate a top header 50 and bottom header 52, respectively. These figures also show a top plate 40 and bottom plate 42 inserted to interfit with recessed areas above and below EPS cores 54 and 56. The top header 50 is used above a door or window opening; and, in addition to the top plate 40, a pair of opposing 9½" web channels 58 are attached and glued to the insulating EPS core 54 each channel 58 having opposing channel flanges 59 facing an opposing header skin 61. A wooden header beam 60 is attached at the bottom of the top header 50 and on the top of the bottom header 52 to provide a strong fastening or screwing or nailing surface for doors and windows. The bottom header 52 has recessed areas 62, whereas the top header 50 has extended core and channel portions 64.

Figure 7:
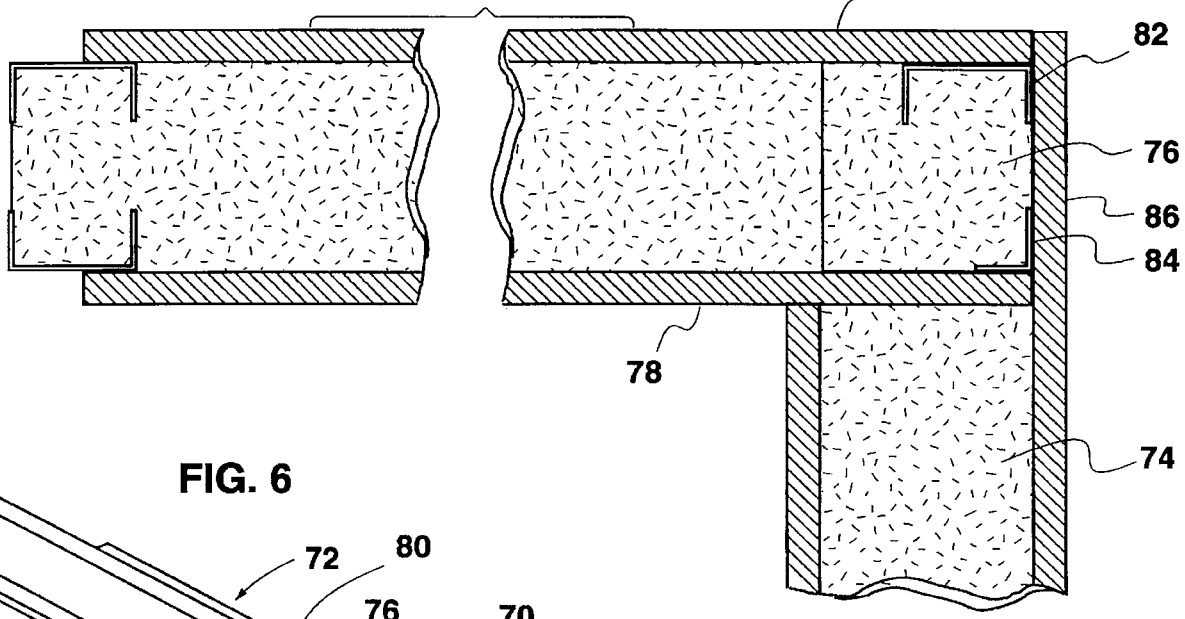
FIG. 7 is a top section view taken along lines 7—7 of FIG. 6.
Figure 6:
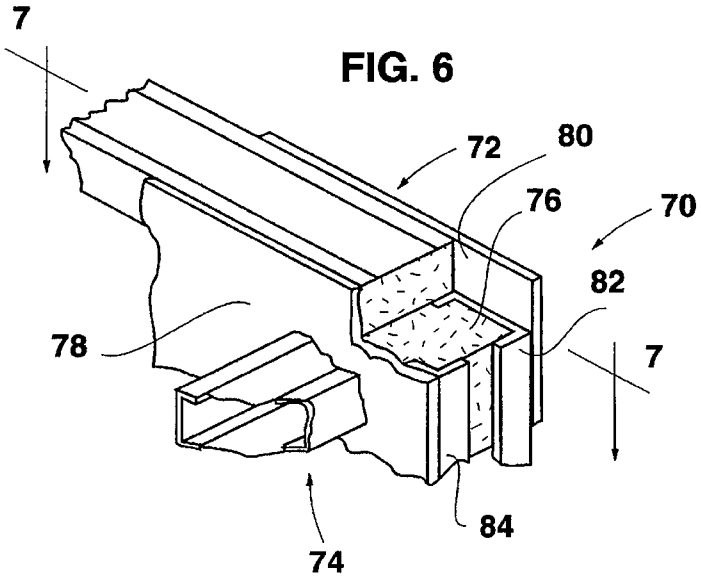
FIG. 6 is a partial-cutaway perspective view of a corner of a wall section.

FIG. 6 illustrates a typical corner 70 perspective view showing the intersection of two top plates 72 and 74 over the corner 70. The EPS core 76 and inner OSB 78 have been notched to allow top plate 74 to butt up against outer skin 80. Comer strength is enhanced by 3½" channel 82 and 1½×1½" angle 84 embedded in EPS core 76. FIG. 7 illustrates the top section view at the bottom of the notch. The corner sections do not have a recessed area or extended core portion. The wall OSB 86 extends over core 76 and can be screwed or nailed into channel 82 and angle 84.

Figure 8:
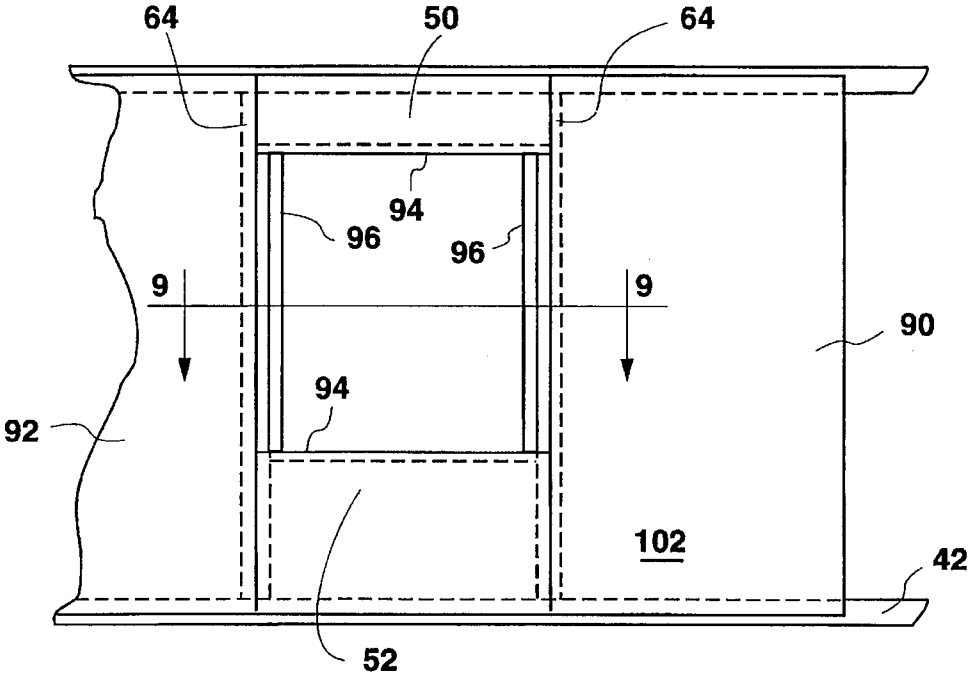
FIG. 8 is a front elevation of a wall and window header.
Figure 9:
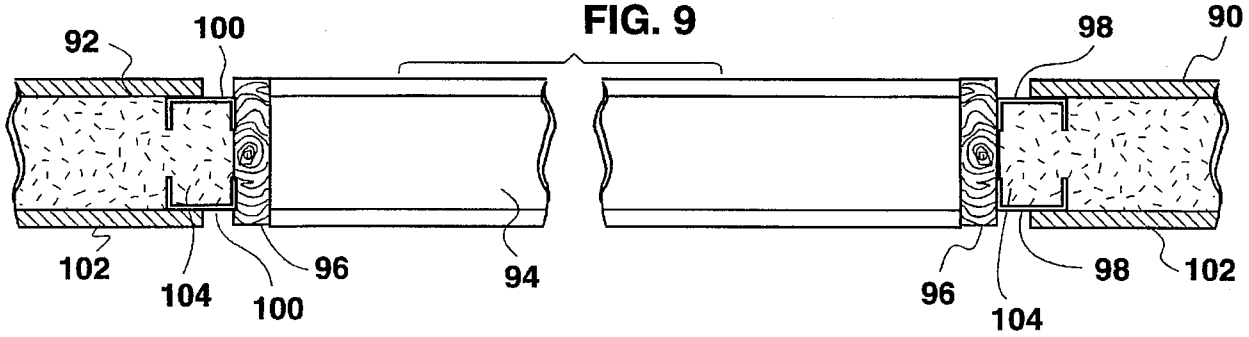
FIG. 9 is a top-section view taken along lines 9—9 of FIG. 8.

Window details can be seen in FIG. 8 elevation and the FIG. 9 section view. Top header 50 and bottom header 52 are attached to adjacent wall sections 90 and 92. The window opening is framed by 2×6" sill and header plates 94 and 2×6" side trimmers 96. These wall sections 90 and 92 have opposing channels 98 and 100 that extend beyond OSB 102 and provide vertical support of header 50 at extension of header 64 (see also, FIG. 4A). These channels 98 and 100 extend vertically from bottom plate 42 up to the top header 50. The panels 90 and 92 for doors and windows differ from regular wall sections (FIG. 3A) in that the lower sections adjacent the door or window opening have extended core 104 and channel portions, wherein the upper sections, i.e., above 64, are recessed to interfit with header 50.

Figure 11:
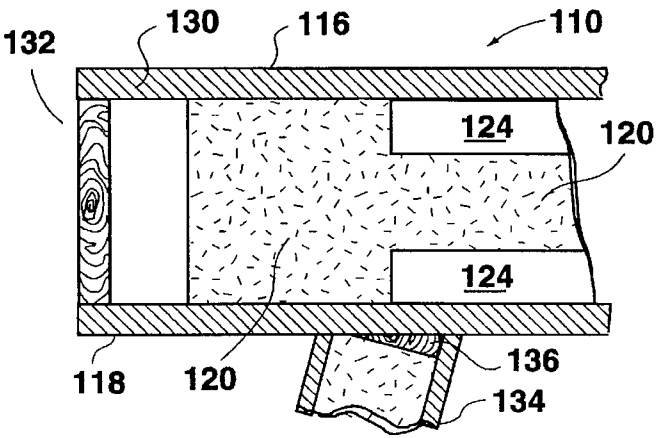
FIG. 11 is a section view of a roof panel taken long lines 11—11 of FIG. 10.
Figure 10:
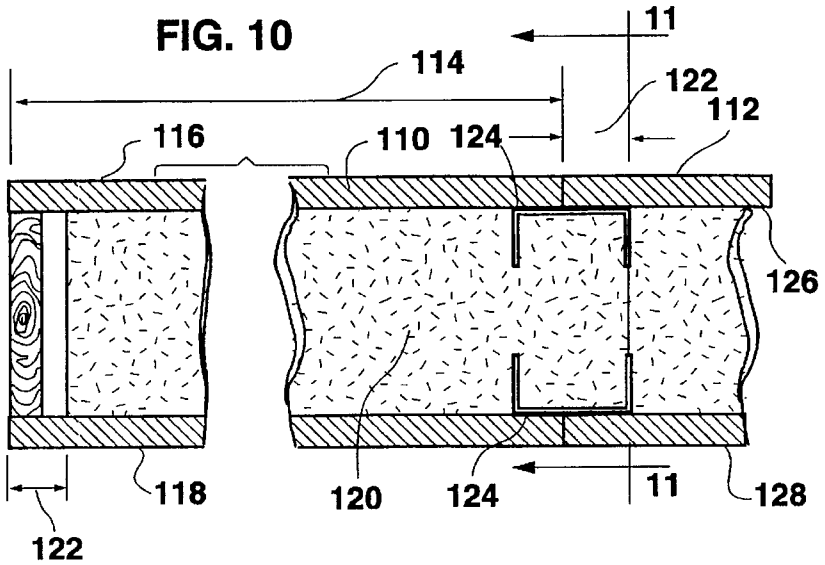
FIG. 10 is a side-section view of a roof panel.
Figure 12:
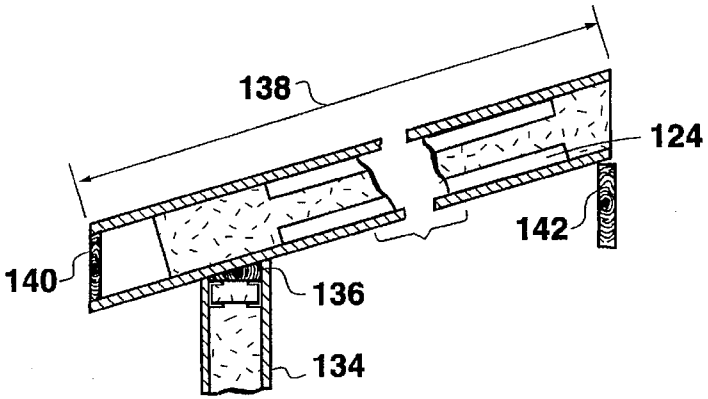
FIG. 12 is an end-section view of a roof panel in place on a wall section.

FIGS. 10, 11, and 12 illustrate the interlocking roof panel construction. FIG. 10 shows two adjoining roof sections 110 and 112. Roof section 110 is typically going to be 4' long as shown at 114 and consists of OSB upper and lower skins 116 and 118 sandwiched and glued to EPS core 120. As in the previous panel construction, the recessed area dimension 122 is 1¾". Again, opposing channels 124 are inserted at an end of EPS core 120 that interfits with adjacent skins 126 and 128.

FIG. 11 illustrates an edge-section view and shows the overhanging caves 130 and a 1" OSB subfacia 132. A short section of wall 134 is shown supporting roof section 110 by means of pitch block 136.

FIG. 12 illustrates a total roof panel section 110 that can have a length 138 of about 28 feet. This roof has a plumb-cut subfacia 140 and is supported by wall panel 134 and pitch block 136 at one end and the ridge board 142 at the other end.

Figure 13:
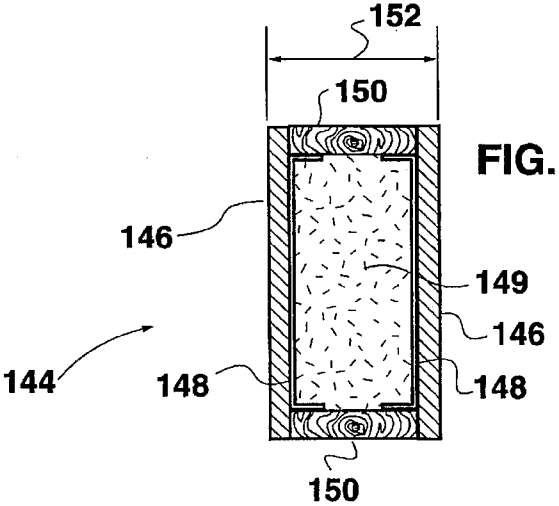
FIG. 13 is a section view of a structural beam.

FIG. 13 illustrates a lightweight structural beam 144 formed from OSB panels 146, opposing galvanized steel channels 148, glued to an ESP core 149, and having a wooden top and bottom plate 150. A typical width 152 would be 6" or 8" and a depth would be dependent on the span or length of the beam.

Figure 14:
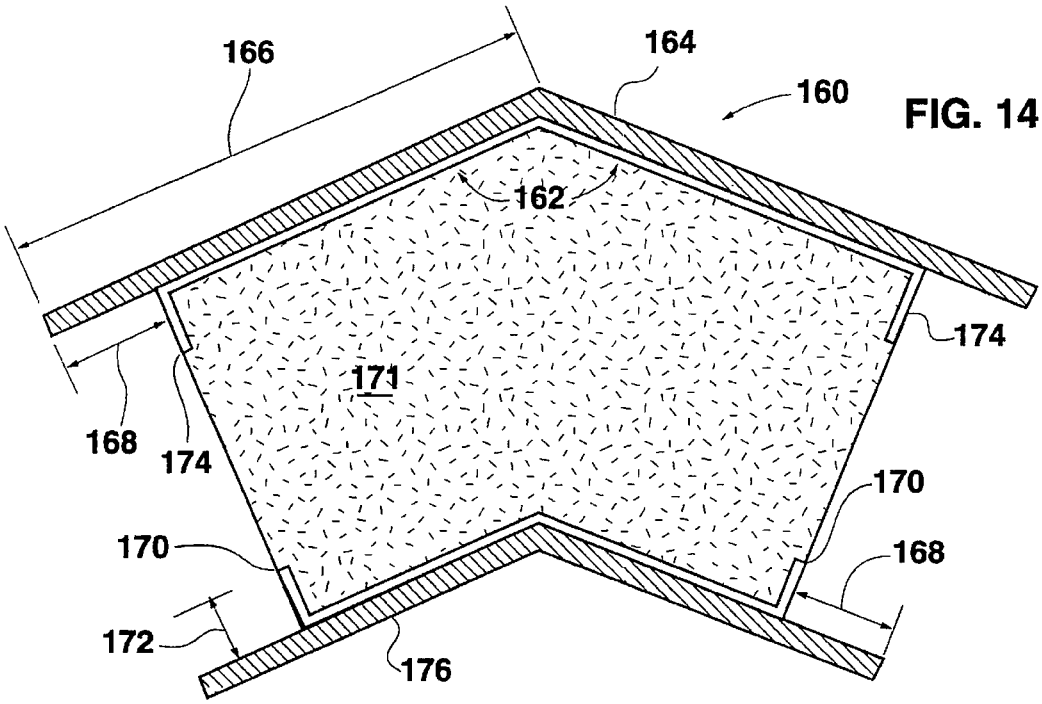
FIG. 14 is a top section view of a 45° angle post having female ends.

FIG. 14 discloses a corner post embodiment 160 having a 45° angled channel at 162. The outer wooden OSB skin 164 having an outer dimension 166 of about 7½" allows interfitting with an adjacent "male" section at the dimension 168, which is about 1 ¼" depth.

Inner flanges 170 face the outer surface of the core 171 and are about 1¼" in depth at 172. The outer flanges 174 face the inner core surface and inner OSB 176.

Figure 15:
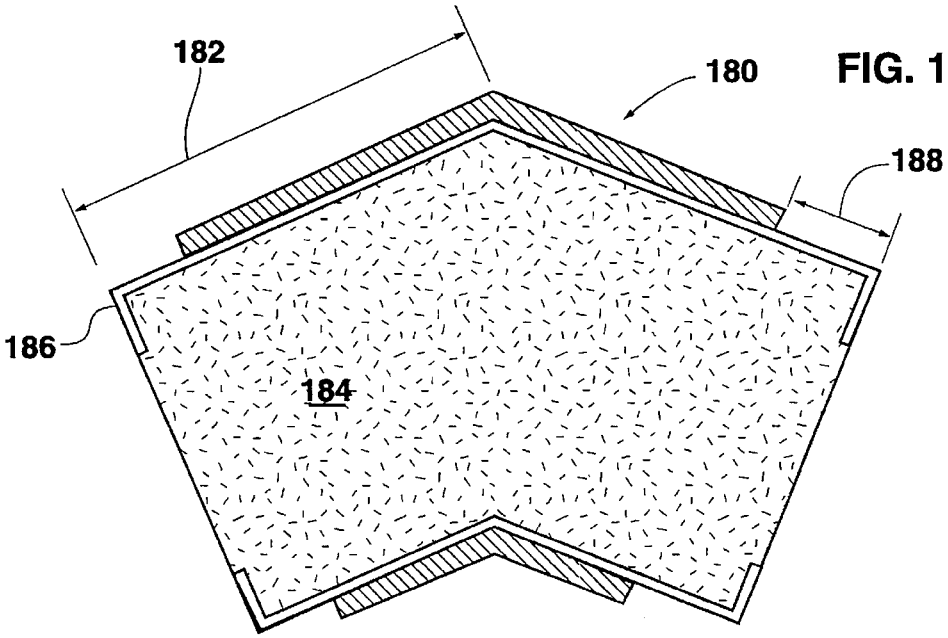
FIG. 15 is a top section view of a 45° angle post having male ends.

FIG. 15 discloses a "male" interfitting corner post 180. In this embodiment, the dimension 182 is about 6" to the end of the core 184 and flange 186 which faces the inner surface of the core. The exposed male portion dimension 188 is about 1¼"

Figure 16:
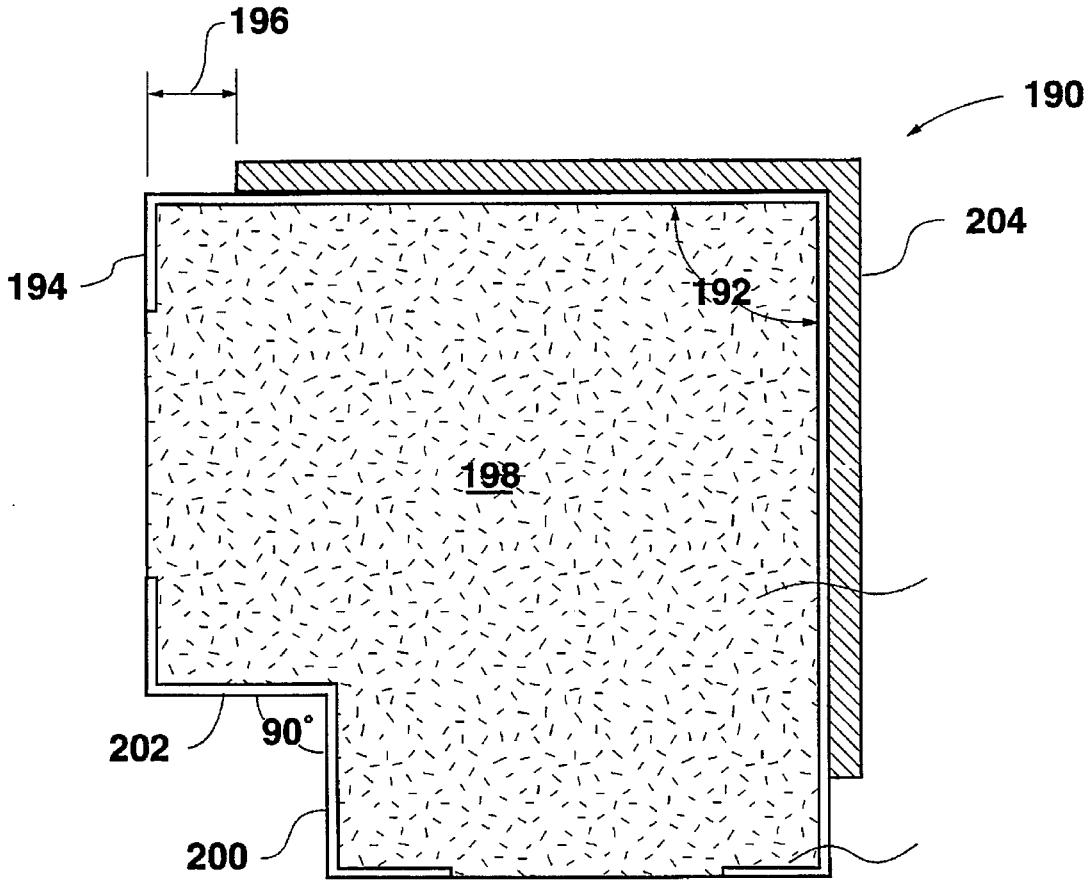
FIG. 16 is a top section view of a 90° angle post.

FIG. 16 discloses a second embodiment corner post 190 having a 90° angled channel at 192. The extended section of core and bent channel flange 194 is about 1¼" at dimension 196. The flange 194 faces the inner surface of core 198. The inner metal channel shaped section 200 is also bent to 90° and has a dimension of about 2" at dimension 202. In this post, the OSB 204 is on the outer surface of the core 198. In all the FIGS. 14, 15, and 16, the OSB is glued to the channel section and the channel sections are glued to the core providing an extremely strong but light structural post.

The material used for the insulating panels is expanded polystyrene having a density of between one and two pounds-per-square-foot, a conductivity K factor rating of about 0.2 Btu/hr.ft$^2$.°F.inch and a compressive strength of between 12 and 30 psi depending on the density. Galvanized sheet metal brackets are used throughout the construction where there is an intersection of roof panels or beams and sills.

While a preferred embodiment of the invention has been disclosed, various modes of carrying out the principles disclosed herein are contemplated as being within the scope of the following claims. Therefore, it is understood that the scope of the invention is not to be limited except as otherwise set forth in the claims.

What is claimed is:

1. A modular construction component comprising:

(a) an insulating core; and (b) a pair of metal channels attached to the core wherein the metal channels are attached and glued on opposing sides of the core, each channel having opposing channel flanges extending toward an opposing side of the core wherein a first flange of each of the metal channels covers a portion of an edge of the core, and a second flange of each of the channels is imbedded in the core, said flanges thereby providing structural strength for the component and avoiding a thermal short between the channels.

2. The component of claim 1 further including inner and outer wooden skins, wherein the core and channels are fixedly sandwiched between the inner and outer skins in a manner allowing for modular interfitting of the component with a mating modular component.

3. The component of claim 2 wherein a portion of the core is recessed within the inner and outer skins and wherein a portion of the core extends beyond the inner and outer skins for modular interfitting of the component with a mating modular component.

4. A rectangular wall section having inner and outer wooden wall skins, the wall section further comprising:

(a) an insulating rectangular wall core sandwiched between and glued to the wall skins, said wall core having a first exposed vertical edge extending beyond the skins; and (b) a pair of metal wall channels attached and glued to opposite exposed sides of the wall core, each channel having opposing channel flanges extending toward an opposing wooden wall skin, wherein a first flange of each wall channel covers a portion of a first edge of the core and a second flange of each wall channel is embedded in the wall core, and wherein a second vertical, wall core edge and a top and a bottom core portion have a recessed area within the wall skins.

5. A top plate and bottom plate adapted for interfitting within a top and bottom core portion recessed area of a wall section, each plate comprising:

(a) an elongate rectangular insulating beam; and (b) a pair of metal plate channels attached and glued to two opposing edges of the insulating beam, each plate channel having opposing channel flanges extending toward an opposing edge of the beam.

6. A top header comprising:

(a) inner and outer rectangular wooden top header skins;

(b) a rectangular insulating top header core sandwiched and glued between a pair of opposing metal header channels and the inner and outer top header skins, and having a recessed area in a top portion of the top header, each header channel having opposing channel flanges extemding toward an opposing header skin; and (c) a wood plate adjacent to a bottom portion of the top header core.

7. A bottom header comprising:

(a) inner and outer rectangular wooden bottom header skins;

(b) a rectangular insulating bottom header core sandwiched and glued between a pair of opposing metal bottom header channels and the inner and outer bottom header skins, and having a recessed area in a bottom portion of the bottom header, each header channel having opposing channel flanges extending toward an opposing header skin; and (c) a wood plate adjacent to a top portion of the bottom header core.

8. A rectangular roof section comprising:

(a) upper and lower rectangular wooden roof skins;

(b) a rectangular insulating roof core sandwiched and glued between the roof skins, said roof core having a first exposed edge extending beyond the skins and a second opposite edge having a recessed area; and (c) a pair of opposing metal roof channels attached and glued on opposing sides of the roof core, each roof channel having opposing channel flanges extending toward an opposing roof skin, and wherein a first flange of each roof channel covers a portion of a first edge of the core and a second flange of each roof channel is embedded in the roof core, thereby permitting interfitting of the first edge within a recessed area of an adjacent roof section.

9. A modular construction system comprising:

(a) a rectangular wall section having inner and outer wooden wall skins, the wall section further comprising:

(i) an expanded polystyrene rectangular wall core sandwiched between and glued to the wall skins, said wall core having a first exposed vertical edge extending beyond the skins;

(ii) a pair of metal wall channels attached and glued to opposite exposed sides of the wall core, each wall channel having opposing channel flanges extending toward an opposing wall skin, wherein a first flange of each wall channel covers a portion of a first edge of the core and a second flange of each wall channel is embedded in the wall core, and wherein a second vertical wall core edge and a top and a bottom core portion have a recessed area within the wall skins;

(b) top plate and bottom plate each comprising:

(i) an elongate rectangular expanded polystyrene beam;

(ii) a pair of metal plate channels attached and glued to two opposing edges of the beam, each plate channel having opposing channel flanges extending toward an opposing edge of the beam, wherein the top and bottom plates interfit within the top and bottom core portion recessed areas of the wall section;

(c) a top header comprising:

(i) inner and outer rectangular wooden top header skins;

(ii) a rectangular expanded polystyrene top header panel sandwiched and glued between a pair of opposing metal header channels and the inner and outer top header skins, each header channel having opposing channel flanges extending toward an opposing top header skin and the top header having a recessed area in a top portion of the top header panel;

(iii) a wood plate adjacent to a bottom portion of the top header panel;

(d) a bottom header comprising:

(i) inner and outer rectangular wooden bottom header skins;

(ii) a rectangular expanded polystyrene bottom header panel sandwiched and glued between a pair of opposing metal bottom header channels and the inner and outer bottom header skins, the bottom header channels having opposing channel flanges extending toward an opposing bottom header skin, and the bottom header having a recessed area in a bottom portion of the bottom header panel;

(iii) a wood plate adjacent to a top portion of the bottom header panel;

(e) a rectangular roof section comprising:

(i) upper and lower rectangular wooden roof skins;

(ii) a rectangular expanded polystyrene roof core sandwiched and glued between the roof skins, said roof core having a first exposed edge extending beyond the roof skins and a second opposite edge having a recessed area;

(iii) a pair of opposing metal roof channels attached and glued on opposing exposed sides of the roof core, each roof channel having opposing channel flanges extending toward an opposing roof skin, and wherein a first flange of each roof channel covers a portion of a first edge of the core and a second flange of each roof channel is embedded in the roof core, thereby permitting interfitting of the exposed edge within a recessed area of an adjacent roof section;

(f) a structural beam comprising:

(i) inner and outer oriented strand board beam skins; and (ii) a rectangular expanded polystyrene beam core sandwiched and glued between a pair of opposing metal beam channels and the inner and outer beam skins, each beam channel having opposing channel flanges extending toward an opposing beam skin, and each beam having a wooden upper top and bottom plate adjacent to the core.

10. The construction system as recited in claim 9 wherein the wall skin and top and bottom header skins are oriented strand board (OSB) of about ⅜ to 1-inch thickness.

11. The construction system as recited in claim 10 wherein the wall skin OSB is a four-foot-by-foot sheet.

12. The construction system as recited in claim 9 wherein the metal wall channels, plate channels, and header channels are formed from galvanized steel from about 0.03 to 0.06-inch thickness.

13. The construction system as recited in claim 9 wherein the expanded polystyrene has a thermal conductivity K factor of about 0.2 Btu/hour.square foot.degree F.inch and a density in the range of 1–2 pounds per cubic foot.

14. A corner post adapted for interfitting with an adjacent modular wall section and header section, the post comprising:

(a) an insulating core having an interior and exterior 90° angle surface;

(b) an outer metal channel-shaped section angled at 90° and glued to an outer surface of the core, the outer section having flanges extending toward the interior surface of the core;

(c) an inner metal channel-shaped section angled at 90° and glued to an inner surface of the inner core, the inner section having flanges extending toward the exterior surface of the core; and (d) a pair of wooden skins attached to an outer surface of the metal channel-shaped sections.

15. A corner post adapted for interfitting with an adjacent modular wall section and header section, the post comprising:

(a) an insulating core having an interior and exterior 45° angle surface;

(b) an outer metal channel-shaped section angled at 45° and glued to an outer surface of the core, the outer section having flanges extending toward the interior surface of the core;

(c) an inner metal channel-shaped section angled at 45° and glued to an inner surface of the core, the inner section having flanges extending toward the exterior surface of the core;

(d) a pair of wooden skins attached to an outer surface of the metal channel-shape sections; and (e) a pair of wooden skins attached to an inner surface of the metal channel-shaped sections.

* * * * *